United States Patent [19]

Locke et al.

[11] Patent Number: 4,950,274

[45] Date of Patent: Aug. 21, 1990

[54] DEPILATORY DEVICE

[75] Inventors: David R. Locke, Bridgeport, Conn.; Nancy E. Terhune, Fair Lawn, N.J.

[73] Assignee: Remington Products, Inc., Bridgeport, Conn.

[21] Appl. No.: 297,247

[22] Filed: Jan. 13, 1989

[51] Int. Cl.[5] ..... A61B 17/00

[52] U.S. Cl. ..... 606/133

[58] Field of Search ..... 128/355, 354; 17/11.1 R, 47; 30/34.2; 606/133

[56] References Cited

U.S. PATENT DOCUMENTS

| | | | |
|---|---|---|---|
| 1,037,067 | 8/1912 | Smith | 17/11.1 R |
| 4,279,253 | 7/1981 | Haes et al. | 128/355 |
| 4,310,968 | 1/1982 | Bulk et al. | 30/34.2 |

*Primary Examiner*—Michael H. Thaler

[57] ABSTRACT

An improved depilatory device is provided having a brush which raises and presents body hairs to the hair removal body.

4 Claims, 2 Drawing Sheets

DEPILATORY DEVICE

FIELD OF THE INVENTION

This invention relates to depilatory devices. The invention relates more particularly to improvements to a hand held, electrically energized depilatory device for removing body hair.

BACKGROUND OF THE INVENTION

Hand held, electrically operated depilatory devices are known in the art and are utilized for removing human body hairs for cosmetic and other purposes. In general, such devices operate by engaging a subject's body hair through a rotating member which member engages and applies a removal force to body hair for uprooting the same. One such device is disclosed in U.S. Pat. No. 4,726,375.

The effectiveness of the depilatory device depends in part on the manipulation of the device by the user, e.g., placement and movement of the device with respect to body hairs to be removed. Body hairs can exhibit characteristics which render initial and even subsequent placement and manipulation of the device ineffective. Some individuals have body hair which tends to be light colored and difficult to see for placement of the device. Body hairs also exhibit a tendency to crop or lay over thus neutralizing to an extent the ability of the gripping member of the depilatory device to engage and remove the hair. The device must be repeatedly scanned over a body site to fully crop the subject's body hairs.

SUMMARY OF THE INVENTION

Accordingly, it is an object of this invention to provide an improved depilatory device for the removal of body hair.

A further object of the invention is to provide an improved depilatory device having means for enhancing the presentation of body hair to be removed to a hair gripping member of the device.

In accordance with the features of the invention, an improved, hand-held, electrically energized depilatory device comprises a housing for the device which is configured to be manually gripped for manipulation of the device. A hair gripping and removal body is mounted to the housing and an electrically energized means positioned within the housing causes rotation of the body for gripping and removal of body hairs. The device includes a hair raising means positioned on the device adjacent the rotating body for raising and presenting to the hair removal body, those hairs which are to be gripped and removed by the body.

In accordance with more particular features of the invention, a guard member is provided and the body hair raising means comprises a brush having a base which is integrally formed with the guard body.

BRIEF DESCRIPTION OF THE DRAWINGS

These and other objects and features of the invention will become apparent with reference to the following specification and to the drawings wherein.

DETAILED DESCRIPTION

Figure 9:
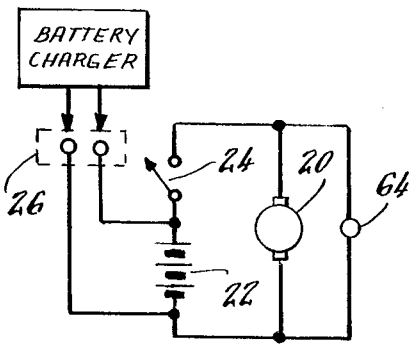
FIG. 9 is a schematic electrical circuit diagram for the device.
Figure 3:
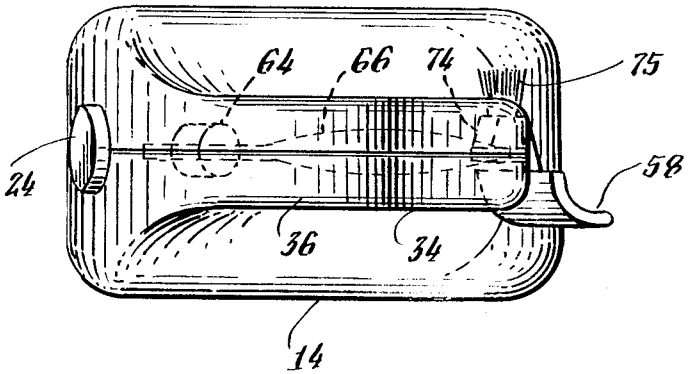
FIG. 3 is a top plan view of the device of FIG. 1.
Figure 4:
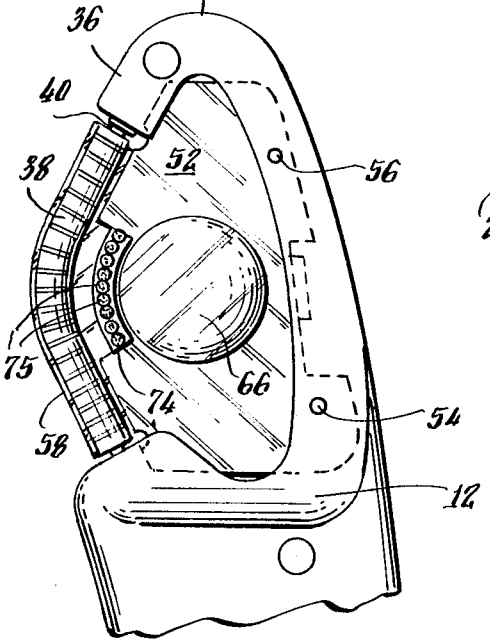
FIG. 4 is a fragmentary, right hand side elevation view of the device of FIG. 1.
Figure 2:
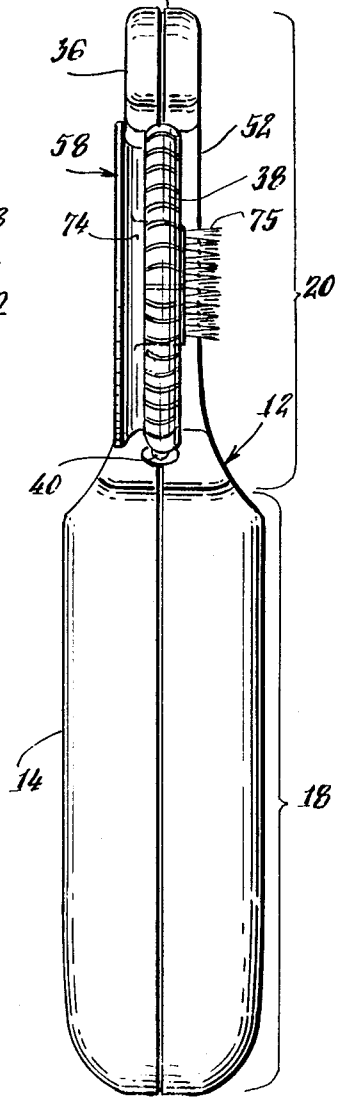
FIG. 2 is a side elevation view of the device of FIG. 1.
Figure 1:
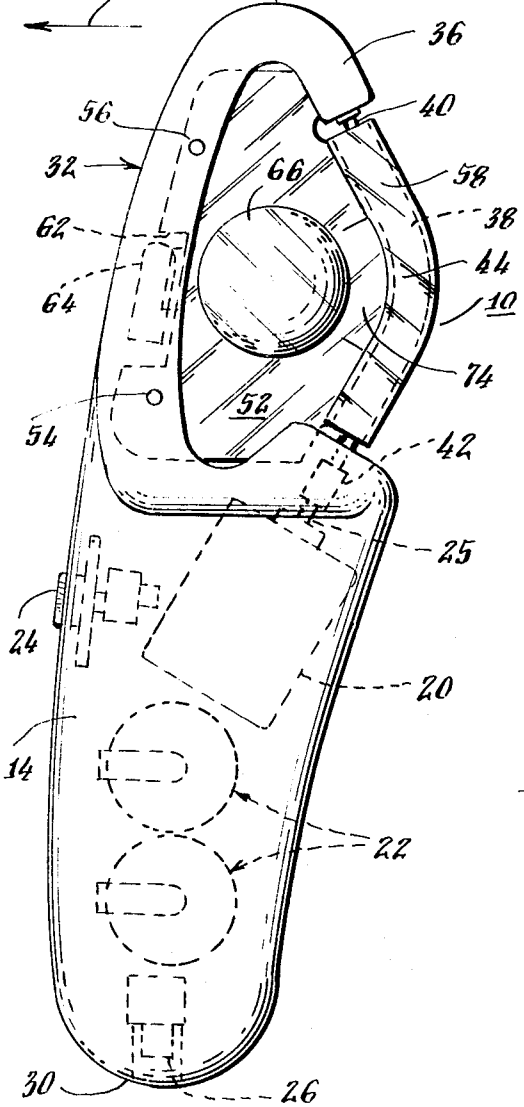
FIG. 1 is a left hand, side elevation view of a depilatory device constructed in accordance with features of the invention and which illustrates by dotted lines, components of the device positioned within a housing for the device.
Figure 7:
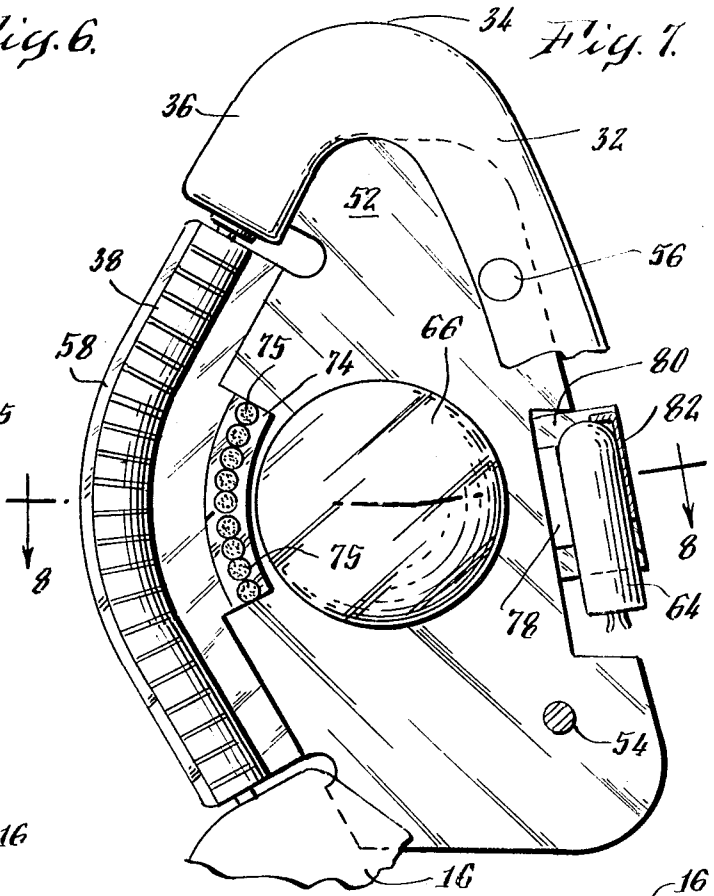
FIG. 7 is a fragmentary, right hand side elevation view of the device of FIG. 5 partly broken away and partly in section.

Referring now to the drawings, a depilatory device indicated generally by reference numeral 10 is shown to have a housing 12 which is configured for manual gripping for manipulation of the device. The housing comprises an assembly of first and second housing members 14 and 16, respectively which when assembled form a handle gripping segment 18 and a hair gripping segment 20. Positioned within the handle gripping segment 18 is an electric motor means 21 which is energized by a battery means 22. A slide switch 24 is provided which, when actuated in a first upward direction as illustrated in FIG. 1, causes the application of electrical energy from the batteries 22 to the motor means 21 and rotation of a motor drive shaft 25. It will be observed that the housing gripping segment 18 is configured for manual gripping and manipulation of the device. In addition, the slide switch 24 is presented for ready actuation. A well known battery recharging circuit means illustrated in block form in FIG. 9 is coupled to a receptacle 26 formed in a first distal end 30 of the handle segment for recharging the battery means 22. FIG. 9 is a schematic diagram of a circuit arrangement for the device and for purposes of simplifying the detailed drawings of FIGS. 1–8, the various electrical wirings are not illustrated in these views but it is understood that the indicated wired corrections of FIG. 9 are provided and routed through the device.

The hair gripping segment 20 is shown to have an arch shaped configuration which is provided in part by a first elongated, relatively narrow housing segment 32 formed by the housing members 14 and 16. The housing segment 32 extends to a second, distal end 34 of the housing. The arch shaped configuration is further provided by a second relatively narrow housing segment 36 which is integrally formed with and extends from the segment 32 part way toward the handle gripping housing segment 18. An opening is thus provided in the arch for receiving a hair removal body 38.

The hair removal body 38 comprises a flexible, plastic member having cuts formed therein along its length, as is described in the aforementioned U.S. Pat. No. 4,726,375. The body further includes a shaft 40 and a drive hub 42 positioned at opposite ends of the body 38. The shaft 40 is positioned in a bearing for rotary motion therein while the drive hub 42 is coupled to the armature drive shaft 25 of the motor means 21 for imparting rotation to the body 38 about its longitudinal axis, 44 when the motor means is energized. When so mounted, the body 38 has an arc or curved configuration as shown.

Figure 8:
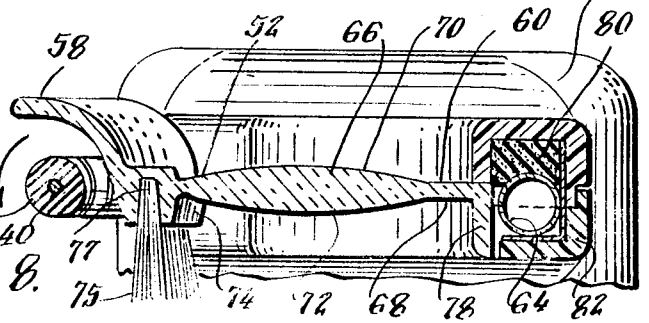
FIG. 8 is a view of the device of FIG. 7 taken along lines 8—8 of FIG. 7.

Placement of the device 10 so that the hair removal body 38 comes into engagement with body hairs at a body site will cause gripping and uprooting of body hairs. In use, the device is stroked above the users skin at a body site from which hair is to be removed. A user may well attempt to advance the body 38 in one of two directions at a body site. One such direction is illustrated by the arrow 46 in FIGS. 1 and 5. Another direction is opposite to the direction indicated by arrow 46. It has been found that the direction of rotation of the body 38 and the direction of stroking are interrelated so that a more efficient removal of body hairs is provided when these motions are coordinated. For most efficient operation, the hair removal body 38 when rotating in a counterclockwise direction as indicated by the arrow 50 in FIG. 8 is stroked in the direction of the arrow 46.

A guard body 52 is provided and is mounted in a window of the device formed by the housing segments 32, 36 and the body 38. The guard member 52 is sandwiched between the assembly of first and second housing members 14 and 16 respectively in the housing hair removal segment 20 which form the elongated housing segment 32. Guard member 52 is located and secured in the housing hair removal segment 20 by circular bosses 54 and 56 which are integrally formed in the housing segments 16 and which engage bores integrally formed in the member 14. Integrally formed with the guard member 52 along one edge thereof is an arc shaped segment 58 which extends from a surface 60 of the guard member 52 and partly about the hair removal body 38. An opposite edge of the guard member 32 is notched as indicated by reference numeral 62 to accommodate placement of a lamp 64, as described hereinafter. The guard member establishes proper orientation of the unit during usage. It also operates to prohibit entanglement of a user's clothing, portions of which may be loosely dangling near the rotating body, with the rotating body. The guard body is formed of a see-through material which provides visibility through the guard body of a body site positioned beneath the guard body. Preferably, the guard member 52 is formed of a clear, polymer plastic as for example, a clear polycarbonate.

Figure 5:
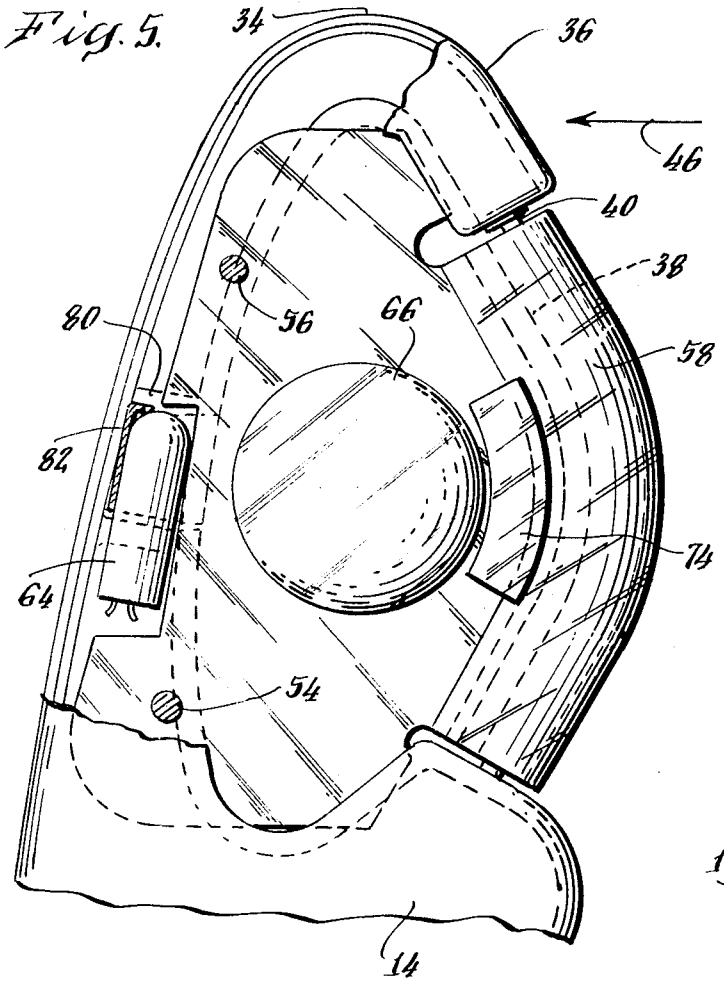
FIG. 5 is an enlarged, fragmentary, left hand side elevation view of the device of FIG. 1 partially broken away, and partly in section.

An optical and illuminating means for enhancing positioning of the device is provided. This optical and illuminating means is described and is claimed in copending U.S. patent application Ser. No. 07/297,189, which is filed concurrently herewith and which is assigned to the assignee of this invention. The optical means is positioned on the device 10 adjacent the rotating hair removal body 38 at a location for presenting to the user an enlarged view of body hairs for gripping by the rotating body 38. As shown in FIG. 1, the optical magnifying means comprises a lens 66 which is integrally formed with the guard member 52. As best seen in FIG. 8, the guard member 52 includes first and second opposite surfaces 60 and 68, respectively which include convex shaped segments 70 and 72, respectively which form the magnifying lens 66. The lens 66 is formed on the guard member at a location which precedes the advancing movement of the hair removal body 38 so as to provide an enhanced, enlarged viewing of hairs which will be engaged by the body 38. As illustrated in FIGS. 1 and 5, the device is stroked or advanced in the direction 46 and the lens 66 is positioned at a location on the guard member 52 which precedes the advancing hair removal body 38.

Figure 6:
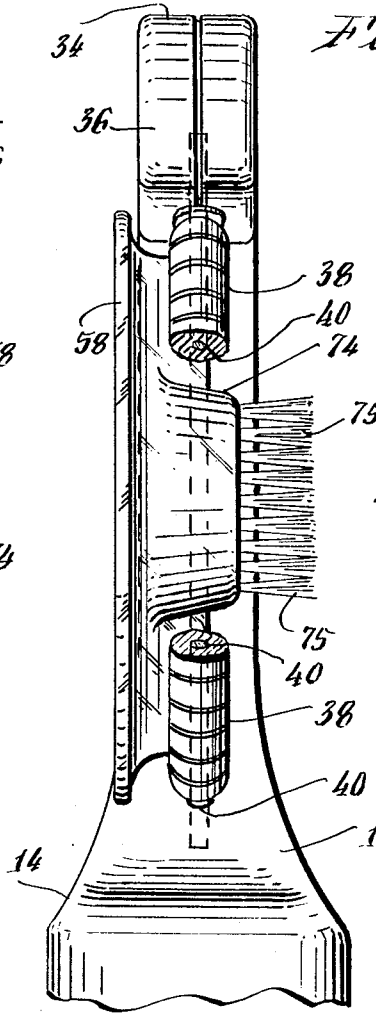
FIG. 6 is a fragmentary, side elevation view of the device of FIG. 5 partly broken away.

A hair raising is also provided. In accordance with a feature of the invention, the guard member 52 includes a hair raising means which is located at a position on the guard member in advance of the movement of the hair removal body 38 for raising and presenting to the hair removal body 38 those hairs which are to be gripped and removed. As illustrated in the drawings, the hair raising means comprises in one embodiment a brush having a base 74 which is integrally formed with the guard member 52. As best seen in FIGS. 6 and 8, the base 74 depends from the surface 68 of the hair removal member 52. It has a generally arc shaped configuration and extends along the length of the hair removal body 38. In addition, it is spaced between the lens 66 and the hair removal body 38 for providing that those hairs which are viewed for removal by the lens 66 will be raised and presented by the brush means to the hair removal body 38. A plurality of bundles of bristles 75 are positioned and secured in a plurality of bores 76 which are formed in the base 74. The bundles are preferably formed of soft nylon bristles and are secured in the bores 76 by any suitable means such as press fitting a shank 77 of the bristles into a bore or by providing a suitable adhesive for securing the shank therein. Alternatively, the hair raising means may comprise a rigid molded comb or bristles of a velcro strip.

A means is positioned on the device 10 for illuminating a body site from which hair is to be gripped and removed by the hair gripping body 38. This means includes the illumination lamp 64 which is electrically energized by the battery means 22 upon actuation of the switch 24. A circuit arrangement illustrating the energization of the lamp 64 is illustrated in FIG. 9. The lamp 64 is mounted within the housing in the elongated segment 32. As best seen in FIG. 8, the lamp 64 is positioned adjacent an extending tab segment 78 of the guard member 52. Tab segment 78 forms a transparent wall member enabling illumination from the lamp to radiate to an area below the surface 68 at a body site from which hair is to be removed. The lamp is secured in position by a resilient packing means 80 such as a foam rubber and an adhesive secures the lamp to the body 80. A reflective means comprising a reflective foil 82 is positioned about and lines wall segments adjacent the lamp 84 for causing light from the lamp 64 which is incident on the foil to be reflected outwardly through the transparent wall segment 78 toward the body site.

An improved depilatory device has thus been described which facilitates the use of the device by the provision of a hair raising means positioned at a location preceding movement of the hair removal body for presenting hair to be removed to the hair removal body. Use of the depilatory device is thus greatly facilitated.

While there has been described particular embodiments of the invention, it will be apparent to those skilled in the art that variations may be made thereto without departing from the spirit of the invention and the scope of the appended claims.

What is claimed is:

1. An improved, hand-held, electrically energized depilatory device comprising:

(a) a housing for said device;

(b) said housing configured to be manually gripped for manipulation of said device;

(c) a hair gripping and removal body mounted to said housing for rotation thereof;

(d) electrically energized means positioned within said housing for causing rotation of said hair gripping body whereby said body when manipulated into contact with human body hairs engages and uproots said body hairs;

(e) said device including a guard member formed of a transparent material for said hair removal body;

(f) a hair raising means comprising a brush having a base thereof which is integrally formed with said guard member; and, (g) said brush positioned on said device adjacent said rotating body for raising and presenting to the removal body hairs which are to be gripped by said removal body and whereby placement of said brush may be viewed by the user.

2. The depilatory device of claim 1 wherein said brush includes a plurality of bundles of brushes and said bundles are mounted to said brush base.

3. The depilatory device of claim 1 wherein said brush base has an arcuate configuration and extends along a length of said hair removal body.

4. The improved depilatory device of claim 1 wherein said hair removal body is adapted to be advanced in a first direction for the engagment and removal of body hairs and said brush base is formed on said guard member at a location preceding the hair removal body in the direction of motion for removal of body hairs.

* * * * *